US005803978A

United States Patent [19]

Amos et al.

[11] Patent Number: 5,803,978

[45] Date of Patent: Sep. 8, 1998

[54] METHOD OF REMOVING BLADES FROM A TURBO MACHINE

[75] Inventors: Dennis Ray Amos, Rock Hill, S.C.; Kent Wixon Beedon, Charlotte; Timothy Lee Driver, Waxhaw, both of N.C.; David Joseph Knapp; Delbert Eugene Conklin, both of Fort Mill, S.C.

[73] Assignee: Westinghouse Electric Corp., Pittsburgh, Pa.

[21] Appl. No.: 684,958

[22] Filed: Jul. 19, 1996

[51] Int. Cl.[6] ..... B08B 3/12

[52] U.S. Cl. ..... 134/1

[58] Field of Search ..... 134/1

[56] References Cited

U.S. PATENT DOCUMENTS

| | | | |
|---|---|---|---|
| 2,616,820 | 11/1952 | Bourgeaux | 148/6.15 |
| 2,771,086 | 11/1956 | Kearney | 134/60 |
| 3,033,710 | 5/1962 | Hightower et al. | 134/1 |
| 3,208,731 | 9/1965 | Gams et al. | 259/2 |
| 3,506,487 | 4/1970 | Lenz et al. | 134/2 |
| 5,202,523 | 4/1993 | Grossman et al. | 42/95 |
| 5,240,506 | 8/1993 | Liers et al. | 134/1 |

*Primary Examiner*—Kriellion S. Morgan
*Attorney, Agent, or Firm*—D. G. Maire

[57] ABSTRACT

A method of removing blades from the rotor of a turbo machine, such as a steam or gas turbine, in which material deposits formed between the surfaces of the blade root and its retaining groove have effectively bonded the blade root to the rotor groove. The blade root and groove are submersed in a liquid medium enclosed in a tank. Transducers installed on the tank radiate ultrasonic pressure waves into the liquid medium that breakup the material deposits through cavitation, thereby loosing the bond between the blade root and the groove. The blade is then removed from the tank and the blade slid out of the groove.

15 Claims, 2 Drawing Sheets

METHOD OF REMOVING BLADES FROM A TURBO MACHINE

BACKGROUND OF THE INVENTION

The present invention relates to a method of removing blades from a turbo machine, such as a steam or gas turbine. More specifically, the present invention relates to a method of removing turbo machine blades from a rotor by using pressure waves, preferably ultra-sonic, in a liquid medium to breakup the material deposits that bond the blade roots into rotor retaining grooves.

A rotor for a turbo machine, such as a steam or gas turbine, typically has several rows of blades arranged along its periphery. Each row of blades comprises a circumferential array of blades spaced equally about the circumference of the rotor. Typically, each blade has a root portion by which it is retained in the rotor. Various blade root shapes have been utilized, such as fir-tree, dove-tail, etc. At assembly, the blade roots are axially slid into correspondingly shaped grooves formed in the rotor circumference. A locking device, such as a pin or tab, is typically used to prevent the blade root from sliding out of the groove. In order to ensure that the blades are securely retained, the clearances between the surfaces of the blade root and the surfaces of the groove are very small, typically less than 0.025 mm (0.001 inch).

For a variety of reasons, material is often deposited in the aforementioned small clearance spaces between the blade root and retaining groove surfaces. For example, since turbo machines often operate at high temperature, material deposits can result from the formation of oxides on the blade root and groove surfaces. In steam turbines, material deposits may also be formed from chlorides or other contaminants in the steam. In gas turbines, such deposits can be formed from contaminants in the fuel or combustion air. Moreover, in some cases, blades are frequency tested in situ in the rotor, which requires that the blade root be held tightly in the groove. In such cases, a locking compound, such a Loctite™, is frequently placed on the blade root surfaces and then cured after the blade has been installed in the rotor so as to lock the blade root into the groove.

Regardless of their source, these material deposits have the effect of bonding the blade root into the groove. This bonding greatly increases the difficulty associated with removing the blades. Such blade removal may be required, for example, to allow inspection or refurbishment of the blades. In the past, removal had been accomplished by injecting a penetrating oil into the groove and then pounding on the blade root with a heavy hammer so as to provide sufficient force to break the bonds, thereby allowing the blade root to be slid out of the groove. This procedure is not only time consuming, it sometimes results in permanently damaging the blade and can be injurious to workers.

It is therefore desirable to provide a method of safely and easily removing blades from a turbo machine rotor in which the blade roots have become bonded to the rotor grooves.

SUMMARY OF THE INVENTION

Accordingly, it is the general object of the current invention to provide a method of safely and easily removing blades from a turbo machine rotor in which the blade roots have become bonded to the rotor grooves.

Briefly, this object, as well as other objects of the current invention, is accomplished in a method of removing blades from a turbo-machine rotor, in which the blade roots have been bonded to the retaining grooves by material deposits, that comprises the steps of (i) submersing at least one of the blade roots and its respective groove into a liquid medium, (ii) radiating pressures waves into the liquid medium in which the blade root and groove are submersed until at least a portion of the material deposits have been broken up, thereby loosening the bond between the blade root and the groove, and (iii) applying a force to slide the blade root out of the groove.

In a preferred embodiment of the invention, the pressure waves are radiated at ultrasonic frequency with sufficient intensity to cause cavitation in the liquid medium.

DESCRIPTION OF THE PREFERRED EMBODIMENT

Figure 1:
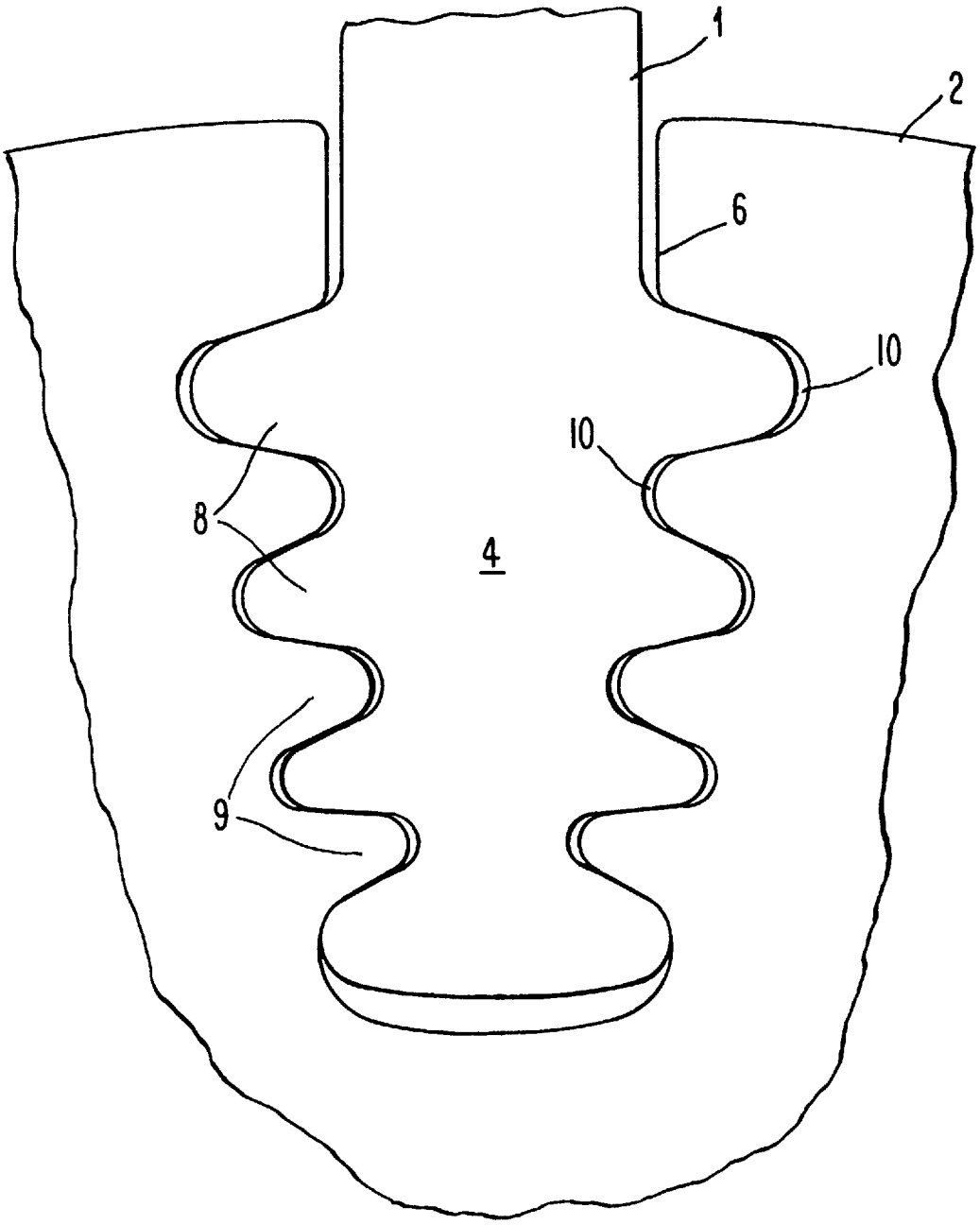
FIG. 1 is a view of a blade root as installed in a groove in the rotor of a turbo machine.

Referring to the drawings, there is shown in FIG. 1 a steam turbine blade 1 as installed in a rotor 2. A blade root 4 is formed at one end of the blade 1. As shown in FIG. 1, the blade root has a serrated, fir-tree shape comprised of a number of lugs 8. However, the invention is equally applicable to other blade root shapes. The blade root 4 is disposed into a groove 6 formed in the periphery of the rotor 2. As is typical, the shape of the groove 6, which has corresponding lugs 9, mirrors that of the blade root 4 so that a considerable portion of the surface of the blade root 4 is in contact with the surface of the groove 6, thereby distributing the circumferential load that the blade root imparts to the rotor 2 during operation. However, as shown in FIG. 1, the groove 6 is slightly larger than the blade root 4 so that small clearance gaps 10 are formed between the surfaces of the blade root and the surfaces of the groove.

Figure 2:
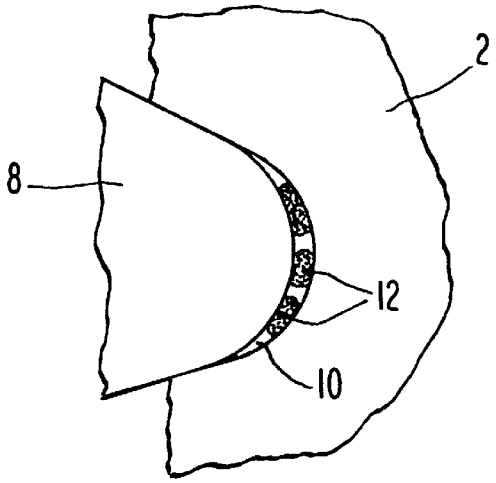
FIG. 2 is an enlarged view of a portion of the blade root and rotor groove shown in FIG. 1 showing the material deposits formed in the clearance between the surface of the blade root and the surface of the groove.

As shown schematically in FIG. 2, material deposits 12 may be formed between the surfaces of the blade root and groove, especially within the clearance gaps 10, as previously discussed. These deposits 12 essentially bond, or bind, the blade root 4 into the groove 6, making it very difficult to slide the blade root out of the groove when it is necessary to remove the blades 1 from the rotor 2.

Figure 3:
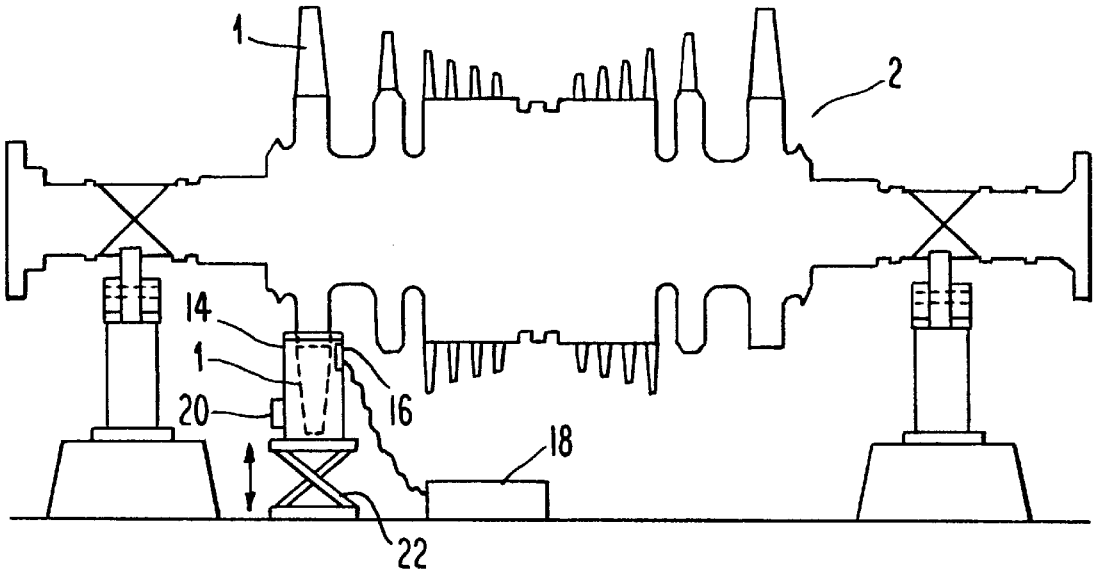
FIG. 3 is a view of a steam turbine rotor undergoing blade removal according to the current invention.

As shown in FIG. 3, according to the current invention, blade removal is accomplished by submersing a blade 1, including its root 4 and the rotor groove 6 into which the blade root is installed into a tank 14 containing a liquid medium. Using techniques well known in the art, one or more transducers 16, which are connected to an electrical generator 18, are mounted on a wall of the tank 14. The transducers 16 radiates pressure waves into the liquid medium, thereby causing alternating compression and rarefaction waves. Preferably, the power level at which the waves are radiated is of sufficient intensity to cause microscopic bubbles to be formed within the liquid medium. The bubbles are sufficiently small to penetrate between the surfaces of the blade root 4 and rotor groove 6. The pressure waves also cause the bubbles to collapse, a phenomenon known as cavitation, thereby creating forces in the liquid medium that tend to breakup the material deposits and free the blade root from the groove. Once the bond between the blade root and groove has been loosened, the blade can be easily slid out of the groove using relatively little force.

Preferably, the transducer 16 operates at a frequency sufficient to radiate ultrasonic waves, and most preferably operates at a frequency of at least 10,000 Hz or higher. According to a preferred embodiment of the invention, a heating element 20 is incorporated into the tank 14 and the liquid medium is heated to at least 65° C. (150° F.). Such heating promotes the cavitation effect.

Preferably, the liquid medium is comprised of a water soluble oil to which a detergent has been added to reduce surface tension, thereby promoting the delivery of cavitation energy to the material deposits 12. However, a low viscosity penetrating oil can also be used. Cleaning agents, such as orthophosphoric acid, which is useful in removing oxides, may also be added to the fluid medium.

The method of the current invention may be practiced by suspending the rotor 2 over the tank 14 so that the tank is directly under a blade 1. The tank 14 is then raised using a variable height support 22 so as to submerse at least one blade root 4 and rotor groove 6 into the liquid medium. Alternatively, a tank of sufficient length to encompass a number of blades may be utilized and the rotor continuously or intermittently rotated to successively submerse blade roots into the liquid medium.

After the blade roots and rotor grooves have been submersed for a sufficiently long period of time to breakup the material deposits 12 so as to loosen the blade root, the tank is removed and the blades are slid out of the grooves.

Although the current invention has been discussed in connection with a steam turbine blade having a fir-tree type blade root, the invention is equally applicable to other types of blades and other types of turbo machines. Therefore, it should be appreciated that the present invention may be embodied in other specific forms without departing from the spirit or essential attributes thereof and, accordingly, reference should be made to the appended claims, rather than to the foregoing specification, as indicating the scope of the invention.

We claim:

1. A method of removing blade roots from retaining grooves in a turbo machine rotor into which said blade roots have been bonded by material deposits formed in gaps between the blade roots and retaining grooves , comprising the steps of:

a) submersing at least one of said blade roots and its respective groove into a liquid medium;

b) radiating pressures waves into said liquid medium in which said blade root and groove are submersed until a sufficient portion of said material deposits formed in said gaps have been broken up so as to loosen said bond between said blade root and said groove, thereby allowing said blade root to be slid out of said groove; and c) applying a force to slide said blade root out of said groove.

2. The method according to claim 1, further comprising the step of maintaining said liquid medium in a tank.

3. The method according to claim 2, wherein the step of submersing said blade root and groove comprises suspending said rotor above said tank.

4. The method according to claim 3, wherein the step of submersing said blade root and groove comprises rotating said rotor so as to sequentially submerse each of said blade roots and their respective grooves into said tank.

5. The method according to claim 4, wherein the step of rotating said rotor comprises intermittently rotating said rotor so as to submerse each of said blade roots and grooves in said liquid medium for a pre-determined period of time.

6. The method according to claim 1, wherein the step of radiating pressure waves comprises radiating pressure waves sufficient to cause cavitation in said liquid medium.

7. The method according to claim 1, wherein the step of radiating pressure waves comprises radiating ultrasonic pressure waves.

8. The method according to claim 7, wherein the step of radiating ultrasonic pressure waves comprises radiating ultrasonic waves at a frequency of at least 10,000 Hz.

9. The method according to claim 1, further comprising the step of heating said liquid medium prior to said submersion therein.

10. The method according to claim 9, wherein the step of heating said liquid medium comprising heating to a temperature of at least about 65° C.

11. The method according to claim 1, wherein said liquid medium comprises a detergent.

12. The method according to claim 1, wherein said liquid medium comprises a water soluble oil.

13. The method according to claim 1, wherein said liquid medium comprises orthophosphoric acid.

14. The method according to claim 1, wherein the step of radiating pressure waves into said liquid medium comprises radiating said waves so as to cause bubbles to be formed in said liquid medium that are sufficiently small to penetrate into said gaps.

15. The method according to claim 14, wherein said gaps in which said deposits are formed are less than 0.001 inch.

* * * * *